US005275404A

United States Patent [19]

Dimaano et al.

[11] Patent Number: 5,275,404

[45] Date of Patent: Jan. 4, 1994

[54] GOLF PUTTING RING

[76] Inventors: Abdiel A. Dimaano; Gregory F. Dimaano; Larie A. Dimaano, all of P.O. Box 25155, Greenville, S.C. 29616

[21] Appl. No.: 9,129

[22] Filed: Jan. 26, 1993

[51] Int. Cl.[5] ..... A63B 69/36

[52] U.S. Cl. ..... 273/178 R; 206/315.9

[58] Field of Search ..... 273/178R, 178A, 178B, 180, 177R, 177A, 177B, 176B

[56] References Cited

U.S. PATENT DOCUMENTS 1,287,903 12/1918 Daily ..... 273/178 R
1,691,935 11/1928 Paterson ..... 273/178 A
1,979,584 11/1934 Thompson ..... 273/180
2,283,462 5/1942 Richie ..... 273/178 A
4,647,047 3/1987 Little ..... 273/178 A

*Primary Examiner*—George J. Marlo
*Attorney, Agent, or Firm*—Hardaway Law Firm

[57] ABSTRACT

A process for practicing the game of golf providing a ring, having a sloping upper surface symmetrical with respect to a sloping bottom-most surface about a horizontal plane therebetween and having a vertical inner surface, such that the slanted configuration eases a putted ball's entry into the ring and the ultimate height of the ring maximizes the ball's retention within the ring, and a package for displaying a plurality of such rings.

1 Claim, 2 Drawing Sheets

GOLF PUTTING RING

BACKGROUND OF THE INVENTION

This invention relates generally to the art of games and more particularly to a process for practicing golf.

Various prior art devices have existed to enhance the game of golf, including a complex trajectory presentation system, a storage image device, a marker for use on a golf course to indicate a tee location, and an apparatus to display video images of a golf hole on a television monitor. In addition, U.S. Pat. No. 1,979,584 to Thompson discloses a mat in conjunction with concentric rings which are cut away so as to provide a guideway to the center of the mat.

While these prior art devices all provide assistance in the game of golf, the nature of the game lends itself to refinements which promote increased skill in the game, thereby enhancing its recreational value.

SUMMARY OF THE INVENTION

It is thus an object of this invention to provide a process for practicing golf.

It is a further object of this invention to provide a practicing apparatus which promotes putting skills.

It is yet a further object of this invention to provide a golf practicing method to promote increased skill in the game of golf.

It is yet a further and more particular object of this invention to provide a display package for a plurality of such practice apparatus.

These as well as other objects are accomplished by a ring for use in practicing the game of golf, comprising an outer diameter, an inner diameter, a sloping outer surface, a vertical inner surface and a sloping bottom-most surface, wherein the sloping bottom-most surface is symmetrical with respect to the sloping outer surface about a horizontal axis therebetween, such that the bottom-most surface slopes outwardly and upwardly from the ring's inner diameter to intersect the outer surface of the ring and such that the outer surface of the ring slopes inwardly and upwardly from the ring's outer diameter to intersect with the ring's vertical inner surface at the inner diameter of the ring. The process is carried out by providing a ring having diameter approximately that of a regulation golf putting cup, holding the ring, spin-tossing the ring onto any putting surface, positioning a golf ball for play, putting the golf ball with an appropriate club toward the ring, and repeating the above steps for the duration of the practice period.

DETAILED DESCRIPTION

In accordance with this invention, it has been found that the game of golf may be enhanced by the ring and practice method described herein. The ring and practice method can be used outdoors on any putting surface or indoors, particularly on a carpeted floor, at the convenience of the participant. Use of the method enhances the level of skill of the player, adding to the enjoyment of the game. The slanted configuration of the outer surface of the ring eases the putted ball's entry, and the ultimate height of the ring is calculated to maximize the ball's retention once entry has occurred. In addition, the ring's outer surface is symmetrical with its bottom-most surface, allowing for the same orientation of the ring to the putting surface with every toss. Further, the weighted material comprising the ring allows it to be tossed with reasonable accuracy and predictability, meeting the needs of the individual golfer. These as well as other advantages and features will become apparent from the following description given with reference to the various figures of drawing.

Figure 1:
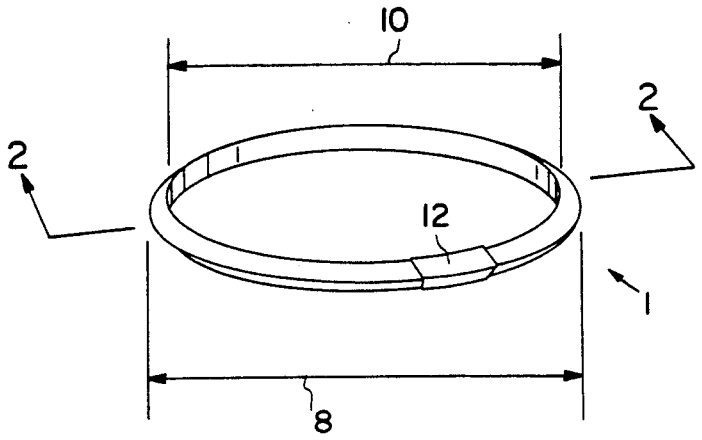
FIG. 1 of the drawings is a perspective view of the ring of this invention.
Figure 2:
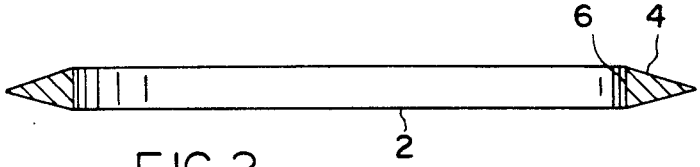
FIG. 2 of the drawings is a cross-section along the line 2—2 of FIG. 1.

One preferred embodiment of metallic ring 1, illustrated in FIGS. 1 and 2 of the drawings, is generally triangular in cross-section. The bottom-most surface 2 of the ring 1 slopes outwardly and upwardly to connect with a sloping outer surface 4. The upper or outer surface 4 slopes inwardly and upwardly, across the width of the ring, to intersect with the inner surface 6 which drops vertically from the points of intersection. The upward slope of the upper or outer surface begins at the ring's outer diameter 8 and terminates at the ring's inner diameter 10 best seen in FIG. 1. It is understood that the terms "bottom-most surface" and "outer surface" are for the purpose of reference only. That is, whether the ring lands "right side-up" or "up-side down" when tossed is immaterial, due to the symmetry of the ring's uniquely designed sloping surfaces about a generally horizontal axis therebetween.

Also seen in FIG. 1 is a securing means 12 for joining separate ends of the material comprising the ring in order to form and retain the ring shape.

Figure 3:
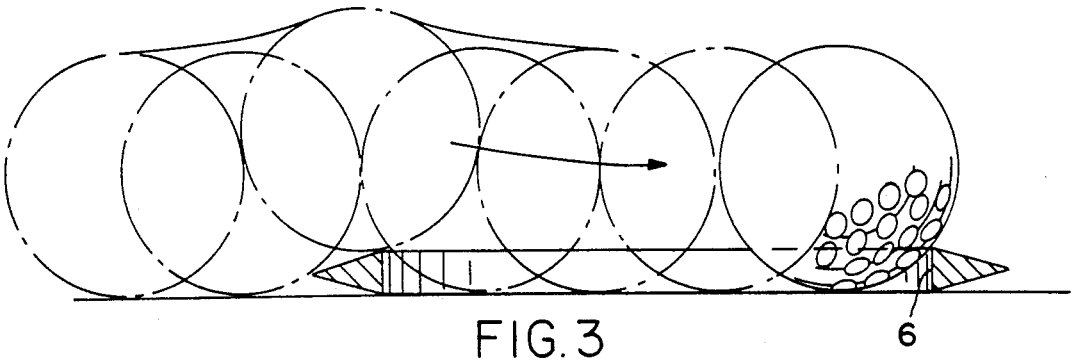
FIG. 3 of the drawings is a partial cross-section illustrating a putted golf ball approaching, entering and being retained inside one preferred embodiment of the ring of this invention.

The preferred embodiment of the ring of this invention discussed above both facilitates a ball's entry into the ring and discourages the ball's exit, once it has entered. As best seen in FIG. 3, slope of the ring's upper or outer surface 4 is minimal enough so that the momentum of the approaching ball carries it inside the ring. The slope is severe enough, however, so that the resulting vertical drop from the highest point of the slope forms an obstruction for a ball which has entered the ring and is moving across the ring's diameter to the vertical surface 6. Thus, the ring enhances the captivity of a ball putted with sufficient force, even if the force is more than required.

Another preferred embodiment of metallic ring 1 comprises a ring of continuous structure. Such embodiment precludes the necessity for a securing means for joining separate ends in order to form the ring shape.

Figure 4:
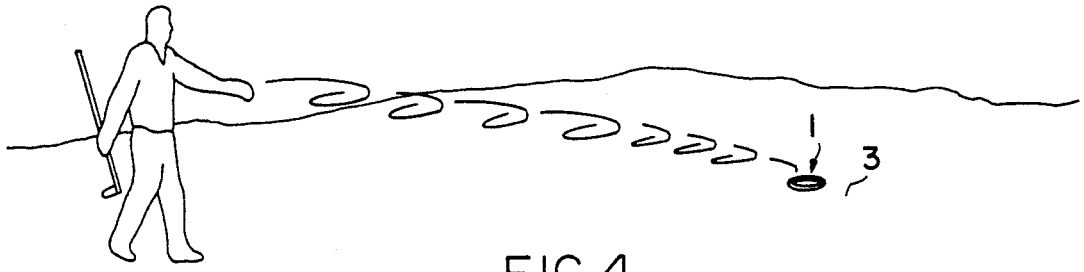
FIG. 4 of the drawings is a schematic perspective view of a golfer spin-tossing a ring in accordance with this invention.

FIG. 4 of the drawings illustrates generally the process of spin-tossing a metallic ring 1, having diameter approximately that of a regulation golf putting cup, onto putting surface 3 in a golf practice setting. The player holds the metallic ring 1 so that it spins as it is tossed onto putting surface 3. The player then positions a golf ball for play and putts the ball with an appropriate club toward metallic ring 1. This process is repeated for the duration of the practice period.

Figure 5:
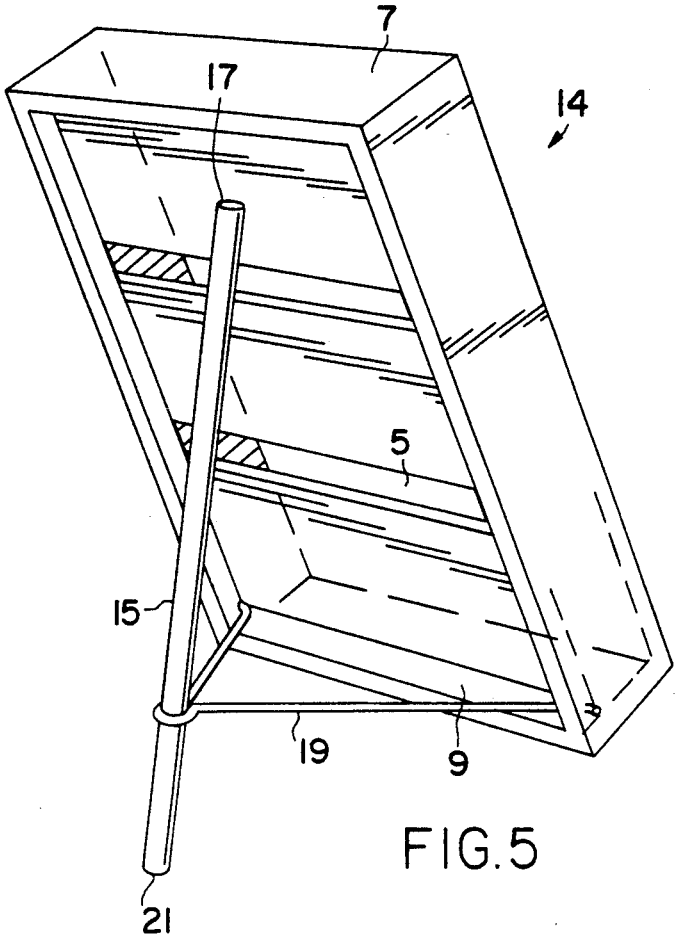
FIG. 5 of the drawings is a perspective view of the general construction of the display package in accordance with this invention.

FIG. 5 of the drawings illustrates a package 14 for displaying a plurality of metallic rings 1 in an open rectangular container 5, having top portion 7 and bottom portion 9.

FIG. 5 further illustrates leg 15 for positioning container 5 at a convenient angle for viewing. First end 17 of leg 15 rests against top portion 7 of container 5, and attachment means 19 connects second end 2 of leg 15 to bottom portion 9 of container 5.

Figure 6:
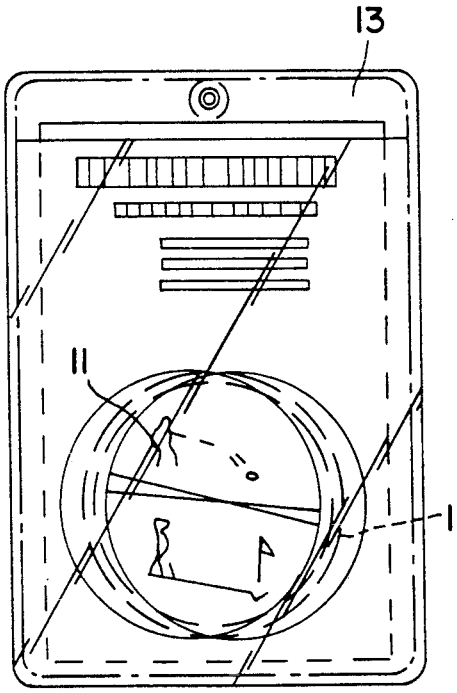
FIG. 6 of the drawings is a plan view of a ring against a golf practice setting background encased in a transparent pocket.

FIG. 6 of the drawings illustrates a sketch 11 depicting a golf practice setting provided as background for ring 1. Both ring 1 and background sketch 11 are encased in a transparent pocket 13, and multiple pockets 13 are then displayed in container 5 of FIG. 5.

While the term "metallic" has been used to describe the ring of this invention, other materials besides metal may be employed in the construction of the ring. Such materials, including polyvinyl chloride (PVC) and various other synthetic materials such as polyethylene, polypropylene, polystyrene, etc., the material marketed under the trademark "Bakelite", have the approximate weight of metal so as to simulate the performance of a metallic ring when tossed. Impregnated plastics may also be utilized to provide appropriate weighting.

It is thus seen that the game of golf is enhanced in accordance with this invention in that there is provided a unique ring and method for practicing the game. It is also seen that this ring and method are promoted by a unique package displaying the metallic ring used in the process of this invention. As many variations will become apparent to those with skill in the art from a reading of the above description which is exemplary in nature, such variations are embodied within the spirit and scope of this invention as defined by the following appended claims.

That which is claimed:

1. A ring for use in practicing the game of golf comprising:

an outer diameter;

an inner diameter;

a sloping upper surface;

a vertical inner surface; and a sloping bottom-most surface;

wherein said sloping upper and bottom-most surfaces are symmetrical with respect to a generally horizontal plane therebetween, such that said bottom-most surface slopes outwardly and upwardly from said vertical inner surface of said inner diameter of said ring and intersects said upper surface of said ring, and said upper surface of said ring slopes inwardly and upwardly from said outer diameter of said ring and intersects said vertical inner surface of said ring at said inner diameter of said ring.

* * * * *